US006684822B1

(12) United States Patent
Lieggi

(10) Patent No.: US 6,684,822 B1
(45) Date of Patent: Feb. 3, 2004

(54) TANKLESS HOT WATER HEATER

(76) Inventor: Damien Lieggi, 2715 Oak St. Ext., Youngstown, OH (US) 44505

( * ) Notice: Subject to any disclaimer, the term of this patent is extended or adjusted under 35 U.S.C. 154(b) by 0 days.

(21) Appl. No.: 10/441,326

(22) Filed: May 20, 2003

(51) Int. Cl.[7] ..... F28C 3/00
(52) U.S. Cl. ..... 122/26; 126/247
(58) Field of Search ..... 122/26; 126/247; 237/12.3 R, 12.3 B

(56) References Cited

U.S. PATENT DOCUMENTS 4,312,322 A 1/1982 Frelhage
4,387,701 A 6/1983 Gibbons
4,554,906 A 11/1985 Newman, Sr. et al.
4,596,209 A 6/1986 Haslach, Jr.
5,392,737 A 2/1995 Newman, Sr. et al.

*Primary Examiner*—Jiping Lu
(74) *Attorney, Agent, or Firm*—Harpman & Harpman

(57) ABSTRACT

An inline heating device for fluid has rotary members frictionally engaging fixed housing extensions on a central fluid transfer conduit. The rotary members are rotated by drive shafts having multiple vein turbine assemblies respectively thereon within the fluid transfer conduit. The rotary members have enhanced friction engagement surface which are spring urged against the fixed housing extension engagement surfaces generating heat therein for thermal transfer to the fluid flow within the transfer conduit driving the turbine assemblies.

12 Claims, 5 Drawing Sheets

TANKLESS HOT WATER HEATER

BACKGROUND OF THE INVENTION

1. Technical Field

This device relates to heating devices that utilize friction coefficients to generate heat and more particularly to fluid heating devices for domestic hot water use.

2. Description of Prior Art

Prior art within this field has been directed to a variety of heat generating devices utilizing friction to heat fluid, see for example U.S. Pat. Nos. 4,312,322, 4,387,701, 4,554,906, 4,596,209 and 5,392,737.

In U.S. Pat. No. 4,312,322 a disk friction heater is disclosed wherein a plurality of disks are driven by a motor. The disks are spaced within a housing and surrounded by oil which heats as the disks rotate.

A fluid friction furnace is illustrated in U.S. Pat. No. 4,387,701 having a plurality of rotating disks and stationery plates within an enclosure filled with heat transfer fluid. An external motor drives the disk producing heat between the disks and the plates.

U.S. Pat. No. 4,554,906 discloses a tankless friction boiler system having rotary members slidably engaged in a housing. An electric motor drives the members producing heat within a fluid transfer environment.

In U.S. Pat. No. 4,596,209 a wind turbine heat generating device is disclosed wherein a wind driven turbine drives a positive displacement pump with adjustable outlets causing fluid to be heated as it passes through the restricted outlets.

Finally, a friction heater is claimed in U.S. Pat. No. 5,392,737 in which a motor rotates a stator that generates heat transfer through a fluid filled housing in communication therewith.

SUMMARY OF THE INVENTION

An economical point of use hot water heating device that requires no outboard energy input utilizing the fluid flow dynamics to generate heat that is in turn transferred to the fluid flow. A pair of turbine assemblies are placed within a restricted fluid flow path rotating outboard friction heating elements generating heat with a thermal heat sink within the fluid's path. The friction engagement elements are configured to maximize thermal generation and transfer to the fluid.

DESCRIPTION OF THE PREFERRED EMBODIMENT

Figure 1:
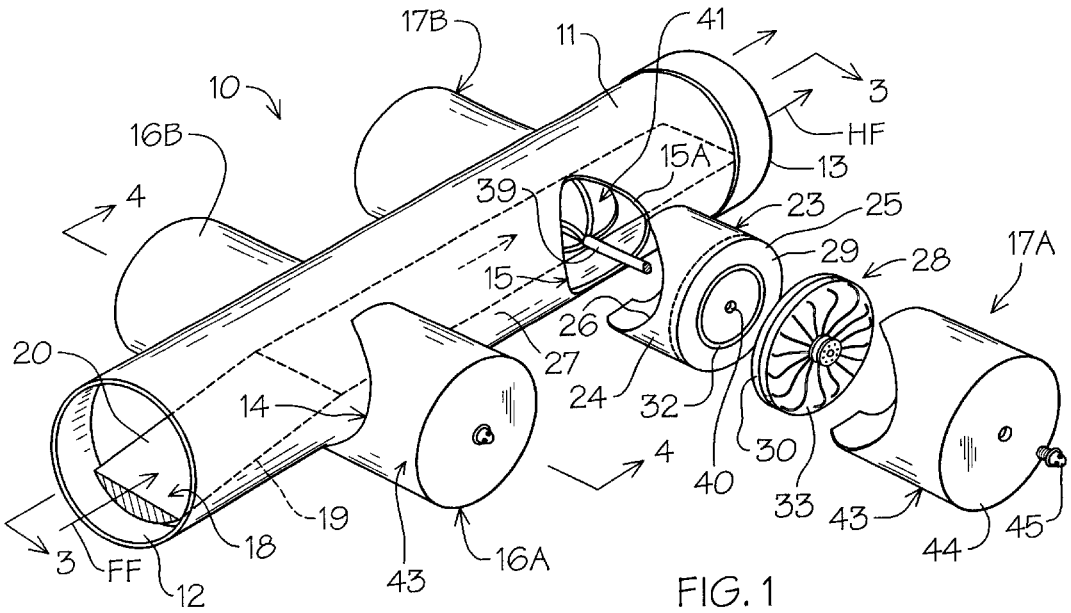
FIG. 1 is a partial exploded perspective view of the tankless hot water heater of the invention.

Referring to FIG. 1 of the drawings, a friction fluid heating device 10 of the invention can be seen having a main cylindrical body member 11 with oppositely disposed open ends at 12 and 13. The cylindrical body member 11 has pairs of longitudinally spaced transversely aligned openings at 14 and 15 therein. Each of the opening pairs 14 and 15 define annular outlets 14A and 14B, 15A and 15B for receiving identical thermal generating assemblies 16A and 16B, 17A and 17B, best seen in FIGS. 1, 2 and 3 of the drawings.

Figure 2:
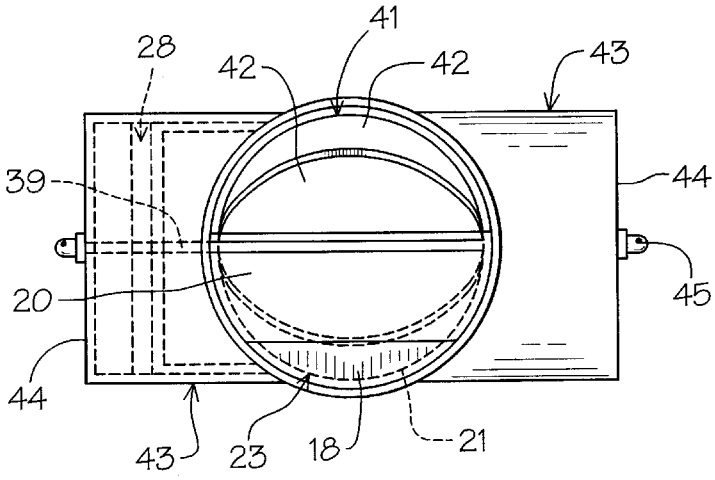
FIG. 2 is an enlarged end plan view thereof.
Figure 3:
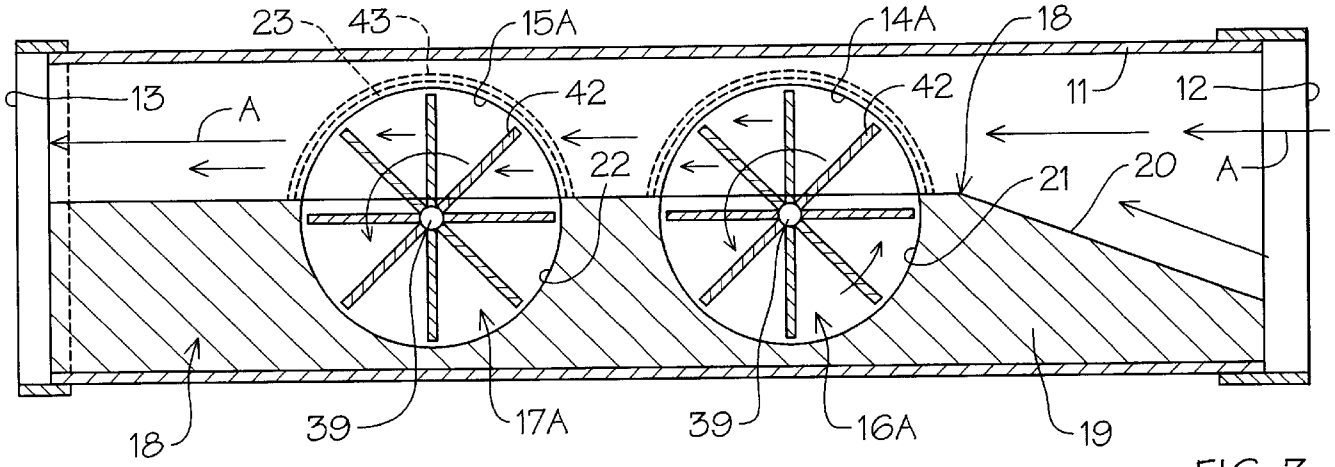
FIG. 3 is an enlarged cross-sectional view on lines 3—3 of FIG. 1.

A cylinder insert 18 best seen in FIGS. 1 and 2 of the drawings has an elongated body member 19 with a tapered end portion 20 and a pair of longitudinally spaced arcuate recesses at 21 and 22 therein. The recesses 21 and 22 are aligned between the respective annular outlets 14A and 14B, 15A and 15B as will be discussed in greater detail hereinafter.

Figure 4:
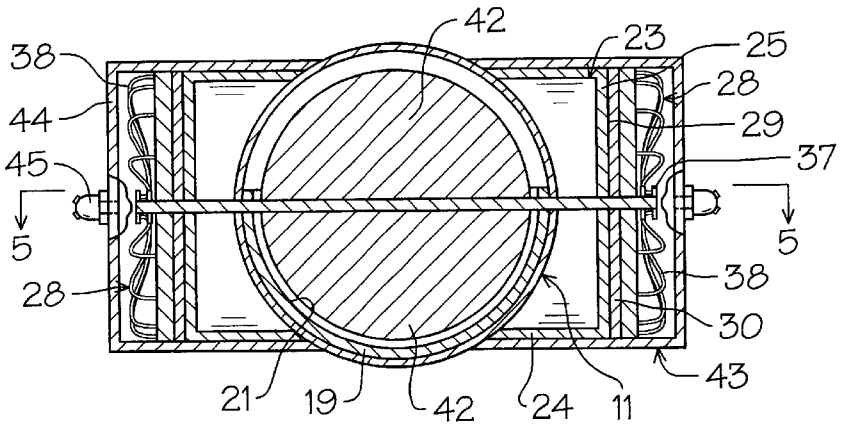
FIG. 4 is an enlarged cross-sectional view on lines 4—4 of FIG. 1.
Figure 5:
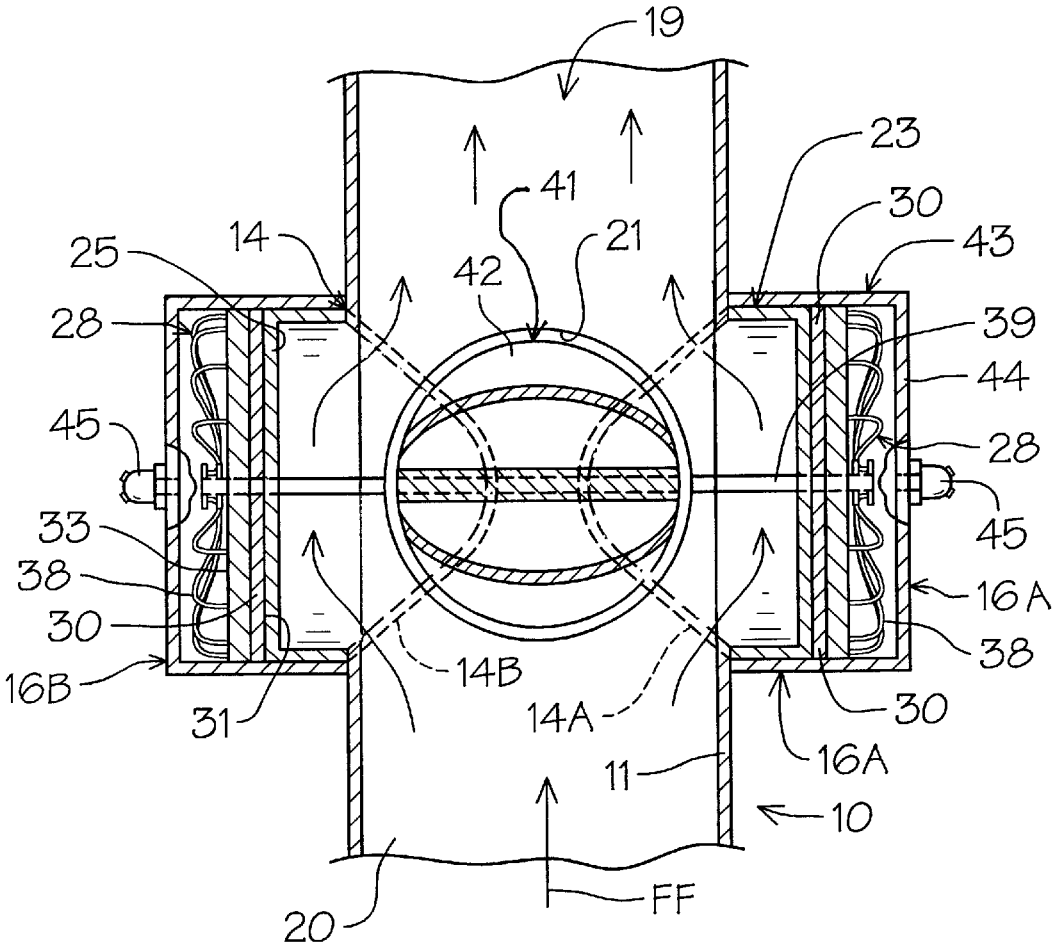
FIG. 5 is an enlarged cross-sectional view on lines 5—5 of FIG. 4.
Figure 6:
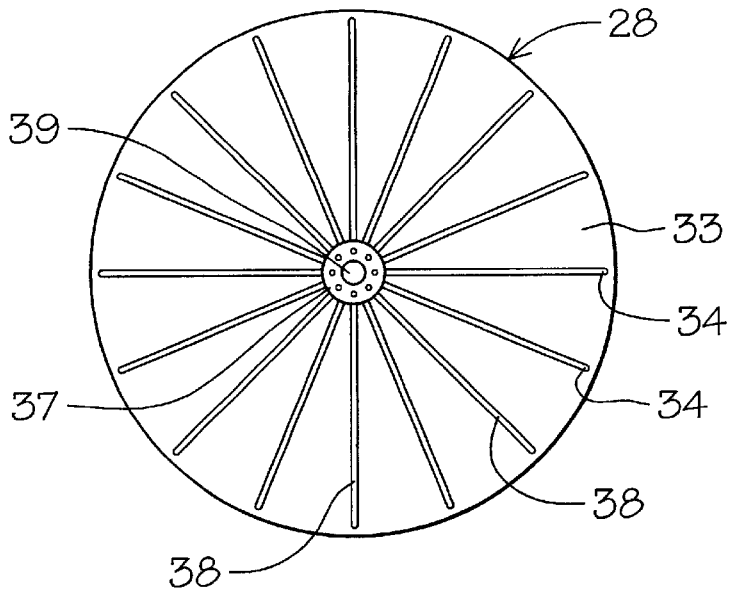
FIG. 6 is an enlarged front elevational view of a friction disk and spider spring assembly of the invention.
Figure 7:
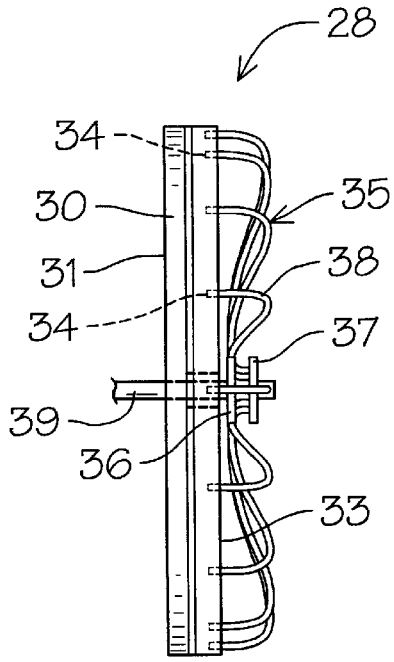
FIG. 7 is an enlarged right side elevational view thereof.
Figure 8:
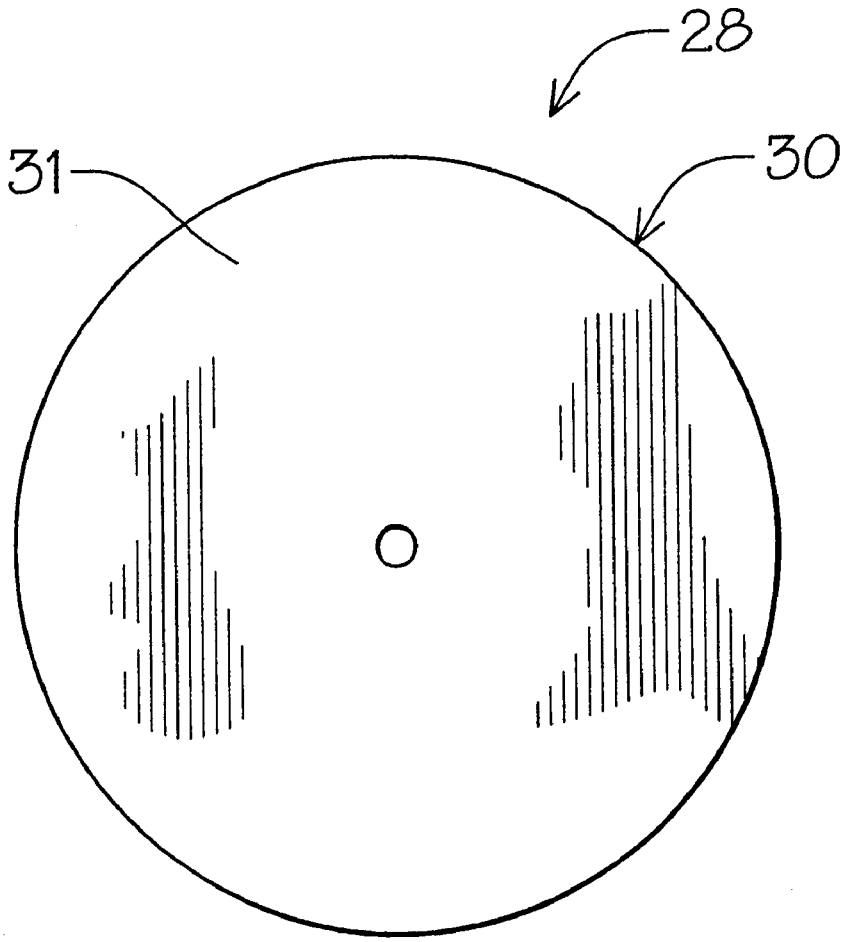
FIG. 8 is an enlarged rear elevational view thereof.

Each of the thermal generating assemblies comprises a thermal engagement transfer housing 23 with a cylindrical side wall 24 and integral end cap portion 25 thereon. The side wall 24 is cut along its perimeter free edge in a contoured pattern at 26 to conform with respective curved surfaces 27 of the main cylindrical body member 11 around the perimeter of the respective annular outlet openings 14A and 14B, 15A and 15B over which the housing 23 will enclose as best seen in FIG. 4 of the drawings.

A friction disk assembly 28 is engageable against the outer surface 29 of the end cap portion 25. The friction disk assembly 28 has a centrally apertured grinding wheel 30 with an engagement surface 31, best seen in FIGS. 6 and 8 of the drawings. The engagement surfaces 31 registerably engage respective end cap portions 25 each of which has an annular wear band 32 embedded within that provides for enhanced frictional engagement therewith. Oppositely disposed surface 33 of the disk assembly 28 have a plurality of annularly spaced mounting sockets 34 therein for registerably receiving a spider spring 35 as seen in FIGS. 6, 7, 8 and 9 of the drawings.

The spider spring 35 has a dual centered apertured hubs 36 and 37 with multiple aligned openings therein for holding individual spring conductor wire and elements 38. The spider spring 35 acts as a resilient chuck maintaining the grinding wheel 30 in frictional contact while diminishing initial rotational torque upon starting up as will be well understood by those skilled in the art.

The friction disk assemblies 28 are secured to respective drive shafts 39 that extend through aligned apertures 40 in the housings 23 from turbine blade assemblies 41 within the cylindrical body member 11.

The turbine blade assemblies 41 each have a plurality of half arcuate blades 42 mounted radially on respective drive shafts 39. The turbine blade assemblies 41 are positioned within the respective cylinder insert recesses 21 and 22, best seen in FIG. 2 of the drawings.

The cylindrical insert 18 as thus described acts as a fluid flow diverter to channel the fluid flow across one-half of the respective turbine blade assemblies 41 indicated by directional arrows A and FF. The frictional disk assemblies 28 are enclosed in a secondary fluid tight cylinder housing 43 that is registerably positioned over the hereinbefore described first housing 18 and against the respective curved surfaces 27 of the cylinder 11.

Apertured integral end closures caps 44 have pressure relief valves 45 on each respectively which provide a safety relief for cylinder housing 43. The relief valves 45 have graduated pressure setting dependent on their position with the system, best seen in FIGS. 1, 2 and 3 of the drawings.

In use, the direct fluid flow FF spins the blades 42 and attached drive shafts 39 rotating the respective friction disk assemblies 28 against the outer end caps 25 surfaces 29 of the housing 23. The kinetic energy inherent therein is converted to thermal output in the form of heat within the transfer housing 23. As a portion of the fluid flow FF passes through the transfer housing 23, the heat generated is given up to heat the fluid F as it passes.

In the preferred embodiment the two respective turbine blade assemblies 41 and multiple interconnected thermal generating assemblies 16A and 16B, 17A and 17B assemblies act in an inline manner providing hot fluid HF from the exit end 13 of the heating device 10 of the invention.

It will thus be seen that the rotating disk assemblies 28 with their configured engagement surfaces define frictional heating that is given up to the constant fluid flow within and across the heat transfer housing 23 as hereinbefore described.

It will be apparent to those skilled in the art that various changes and modifications may be made therein without departing from the spirit of the invention.

Therefore I claim:

1. A heating device for heating fluid material powered by said fluid material comprises;

a cylindrical support housing having a fluid inlet and a fluid outlet, at least one turbine assembly within said cylindrical support housing, a drive shaft means extending from said turbine assembly, means for diverting fluid flow within said cylindrical support housing for engagement with said turbine assembly, a plurality of disks secured to said drive shaft being rotated thereby, a thermal transfer housing extending from and in communication with said cylindrical support housing, a portion of said thermal transfer housing frictionally engaged with said respective disks, means for resiliently urging said disks against said portion of said thermal transfer housing, means for supporting and enclosing said disks extending from said thermal transfer housing, means for pressure relief within said disk enclosing means, said fluid flow circulating through said cylinder support housing and said thermal transfer housing driving said turbines whereby said fluid becomes heated due to the friction against a portion of said thermal transfer housing, said heated thermal transfer housing transferring heat to said fluid flow there within.

2. The heating device set forth in claim 1 wherein said cylindrical support housing has pairs of longitudinally spaced transversely aligned openings therein for said thermal transfer housing.

3. The heating device set forth in claim 1 wherein said means for diverting fluid flow within said cylindrical support housing comprises, an insert having a half-arcuate elongated body member, with a tapered end portion and a pair of turbine receiving recesses there within.

4. The heating device set forth in claim 3 wherein said respective turbine receiving recesses are aligned with said respective thermal transfer housings.

5. The heating device set forth in claim 1 wherein said turbine assembly comprise, a plurality of half-arcuate blades extending radially from said drive shafts.

6. The heating device set forth in claim 1 wherein said means for resiliently urging said disks against said portion of said thermal transfer housing comprises, a spider spring, said spring having a plurality of resilient urged elements extending radially from a dual sprocket assembly to a plurality of annularly spaced receiving sockets in said disk.

7. The heating device set forth in claim 1 wherein said means for supporting and enclosing said disk extending from said thermal transfer housing comprises, friction disk assemblies, having a cylindrical support and enclosure housing, said friction disk assemblies and said means for resiliently urging said disk against said thermal transfer housing are rotatably positioned within.

8. The heating device set forth in claim 7 wherein said friction disk assemblies have a spring engagement portion and a thermal transfer housing engagement portion.

9. The heating device set forth in claim 1 wherein said portion of said thermal transfer housing frictionally engaged with said disks has a wear band of dissimilar material embedded within.

10. The heating device set forth in claim 1 wherein said engagement between said friction disk and said thermal transfer housing generates heat from said friction in said respective engagement surfaces and said fluid flow transfer there through.

11. The heating device set forth in claim 1 wherein said means for pressure relief comprises, pressure relief valves in communication with atmosphere.

12. The heating device set forth in claim 11 wherein said pressure relief valves are of different release pressure dependent on their relative position within the heating device.

* * * * *